US010262846B2

(12) United States Patent
Stresau

(10) Patent No.: US 10,262,846 B2
(45) Date of Patent: Apr. 16, 2019

(54) APPARATUS AND METHODS FOR FOCUSSING ELECTRONS

(71) Applicant: ETP ION DETECT PTY LTD, Clyde, New South Wales (AU)

(72) Inventor: Richard Stresau, Clyde New South Wales (AU)

(73) Assignee: ETP ION DETECT PTY LTD, Clyde, New South Wales (AU)

( * ) Notice: Subject to any disclaimer, the term of this patent is extended or adjusted under 35 U.S.C. 154(b) by 0 days.

(21) Appl. No.: 15/748,022

(22) PCT Filed: Jul. 14, 2016

(86) PCT No.: PCT/AU2016/050612
§ 371 (c)(1),
(2) Date: Jan. 26, 2018

(87) PCT Pub. No.: WO2017/015700
PCT Pub. Date: Feb. 2, 2017

(65) Prior Publication Data

US 2018/0218891 A1 Aug. 2, 2018

Related U.S. Application Data

(60) Provisional application No. 62/198,216, filed on Jul. 29, 2015.

(51) Int. Cl.
*H01J 43/10* (2006.01)
*H01J 43/14* (2006.01)

(52) U.S. Cl.
CPC ..... *H01J 43/10* (2013.01); *H01J 43/14* (2013.01)

(58) Field of Classification Search
CPC combination set(s) only.
See application file for complete search history.

(56) References Cited

U.S. PATENT DOCUMENTS 3,634,713 A * 1/1972 Foote ..... H01J 43/14 313/103 R
4,199,702 A 4/1980 Keneman
(Continued)

OTHER PUBLICATIONS

International Search Report dated Sep. 13, 2016, for corresponding International Patent Application PCT/AU2016/050612 filed on Jul. 14, 2016.

(Continued)

*Primary Examiner* — Douglas W Owens
*Assistant Examiner* — Jianzi Chen
(74) *Attorney, Agent, or Firm* — David D. Brush; Westman, Champlin & Koehler, P.A.

(57) ABSTRACT

An apparatus for generating and focusing electrons is provided. The apparatus has an emissive material configured to emit an electron, an electron target, and an electrical potential gradient generator configured to generate an electrical potential gradient within the emissive material. The electrical potential gradient is oriented so as to vary from positive to negative in the general direction toward the electron target. In operation, an electron emitted from the emissive materials is deflected away from the emissive material and generally toward the electron target. The apparatus may be incorporated in scientific analytical equipment such as an electron multiplier.

20 Claims, 3 Drawing Sheets

(56) References Cited

U.S. PATENT DOCUMENTS

| | | | | |
|---|---|---|---|---|
| 4,710,675 | A | 12/1987 | Stephenson | |
| 4,764,673 | A | 8/1988 | Bryson, III et al. | |
| 5,680,008 | A * | 10/1997 | Brandes | H01J 1/32 313/103 CM |
| 5,986,625 | A * | 11/1999 | Huang | H01J 31/127 345/44 |
| 6,982,428 | B2 | 1/2006 | Stresau et al. | |
| 7,446,327 | B2 * | 11/2008 | Stresau | H01J 43/10 250/281 |
| 2004/0159796 | A1 | 8/2004 | Stresau et al. | |
| 2006/0255283 | A1 | 11/2006 | Stresau | |
| 2011/0049347 | A1 * | 3/2011 | Wells | H01J 49/0054 250/282 |

OTHER PUBLICATIONS

Written Opinion of the International Searching Authority dated Sep. 13, 2016, for corresponding International Patent Application PCT/AU2016/050612 filed on Jul. 14, 2016.

* cited by examiner

APPARATUS AND METHODS FOR FOCUSSING ELECTRONS

CROSS-REFERENCE TO RELATED APPLICATIONS

This Application is a Section 371 National Stage Application of International Application No. PCT/AU2016/050612, filed Jul. 14, 2016, published as WO 2017/015700 A1 on Feb. 2, 2017, in English, which is based on and claims the benefit of U.S. Provisional Patent Application No. 62/198,216, filed Jul. 29, 2015; the contents of which are hereby incorporated by reference in their entireties.

FIELD OF THE INVENTION

The present invention relates generally to components of scientific analytical equipment. More particularly, the invention relates to apparatus and methods for focussing of electrons onto a target electrode.

BACKGROUND TO THE INVENTION

In many scientific applications, it is necessary to focus an electron signal. For example, in a mass spectrometer the analyte is ionized to form a range of charged species. The resultant ions are then separated according to their mass-to-charge ratio, typically by acceleration and exposure to an electric or magnetic field. The separated ions impact on an ion detector to generate a signal. Results are displayed as a spectrum of the relative abundance of detected ions as a function of the mass-to-charge ratio.

The impact of an input ion on the impact surface of a detector may be amplified in some manner, typically by an electron multiplier. Generally the impact surface is incorporated within the electron multiplier. The electron multiplier may operate by way of secondary electron emission whereby the impact of a single or multiple ion(s) on the multiplier surface causes single or multiple electrons associated with atoms of the surface to be released. It is these secondary electrons which form the principle signal to be amplified by the detector.

It is generally desirable for an electron multiplier to have a large sensitive input area so that particles can be detected which are incident over a large area. This requirement often results in a mismatch between the desired sensitive input area and the sensitive area of the amplifying section of the electron multiplier (which is generally significantly smaller). In these circumstances it is desirable to include a focussing element, often referred to as a focussing lens, between the device's input aperture and its amplifying section. The focussed electrons typically impact a target electrode that is entrant to the electron multiplier's amplifying section.

There are many different types of electron multipliers known in the art and for each type there is usually a preferred or optimal manner for focussing electrons. For example, a continuous channel electron multiplier typically utilizes a resistive cone; while an electrostatic discrete dynode electron multiplier often utilizes purely electrostatic focussing. In some electron multipliers the need for focussing is completely obviated, an example being micro channel plate (MCP) electron multipliers.

One type of electron multiplier controls the path of secondary electrons from the emission surface to the target surface by the use of crossed magnetic and electrostatic fields. An example of this form of multipliers disclosed in United States Patent published as U.S. Pat. No. 6,982,428 B2 (to STRESAU et al). These electrostatic/magnetic cross field electron multipliers have significant advantages over alternative electron multipliers. For example, such multipliers display minimal time distortion in electron transit times from the emission surface to the target surface.

A problem of some electrostatic/magnetic cross field electron multipliers of the prior art is that different areas of the ion impact surface exhibit different gains. In some configurations electrons emitted from the impact surface in a region distal to the target electrode undergo several more electron impact cycles than electrons from a region proximal to the target electrode. Each impact cycle results in additional emitted secondary electrons. As a result, a growing number of electrons accumulate across the impact surface. A detector utilizing this arrangement has a very large variation in gain from one end to the other of its ion impact surface and hence its ion input aperture and in effect a significantly reduced effective sensitive area or a skewed response across its sensitive area.

This problem with variable gain might be overcome by arranging the electron impact energy such that the average secondary electron yield (i.e. the average number of secondary electrons emitted from a single electron impact) is close to 1. This solves the gain variation problem but introduces yet a further problem. Because secondary electron emission follows a Poisson distribution for the probability of an emission, using a low average yield leads to a significant probability of no emission at all. An electron impact with an average secondary electron yield of 1.0 will have a 37% probability of zero emission. The net result will be an ion detection efficiency of 63% for the first interaction with a corresponding diminishing efficiency for each successive electron-surface interaction. Clearly, this solution is unacceptable for many applications.

A method for electron focussing was addressed by the inventors of U.S. Pat. No. 6,982,428 by utilizing a reduction in the E/B2 ratio (ratio of the electrostatic field to the square of the magnetic field) along the path of electron flow to accomplish the required focussing. A disadvantage of this system is the need for a large and complex magnetic circuit.

A further problem of the art is that secondary electrons may be reabsorbed into the impact surface. As a result the detector sensitivity progressively diminishes with increased distance from the target end of the impact surface. As discussed supra, this results in the detector having a very large variation in gain from one end to the other of its ion impact surface and in effect a significantly reduced effective sensitive area or a skewed response across its sensitive area.

It is an aspect of the present invention to provide improved means for focussing electrons, and particularly secondary electrons emitted from the impact plate of an electron multiplier. It is a further aspect to provide a useful alternative to prior art means for focussing electrons.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

SUMMARY OF THE INVENTION

In a first aspect, but not necessarily the broadest aspect, the present invention provides apparatus for generating and focussing electrons, the apparatus comprising:

an emissive material configured to emit an electron, an electron target, and an electrical potential gradient generating means configured to generate an electrical potent gradient within the emissive material, the electrical potential gradient being oriented so as to vary from positive to negative in the general direction toward the electron target, wherein, in use, an electron emitted from the emissive material is deflected away from the emissive material and generally toward the electron target.

In one embodiment of the apparatus where the emissive material is solid, the electrical potential gradient generating means is configured to establish an electrical potential gradient across the surface of the emissive material.

In one embodiment of the apparatus the electrical potential gradient generating means is configured to establish an electrostatic field having a series of potential field lines, In one embodiment of the apparatus where the emissive material is solid and the electron target is substantially planar, each of the field lines are substantially orthogonal to the electron target.

In one embodiment the apparatus comprises magnetic field generating means configured to combine with the electrical potential gradient generating means to guide an electron along a trajectory toward the electron target.

In one embodiment of the apparatus the magnetic field generating means is configured to establish a magnetic field having a field direction which is orthogonal or substantially orthogonal to the electrostatic field lines.

In one embodiment of the apparatus where the emissive material is solid, the magnetic field direction is substantially orthogonal to the electrostatic field lines present in a region immediately adjacent the emissive surface.

In one embodiment of the apparatus where the emissive material is solid, the electrical potential gradient generating means and/or the magnetic field generating means is/are configured such that the trajectory of the electron is substantially across the emissive surface and toward the electron target.

In one embodiment of the apparatus where the emissive material is solid the surface of the emissive material is electrically resistive.

In one embodiment of the apparatus where the emissive material is solid, the surface of the emissive surface is not electrically resistive, and comprises a surface having multiple parallel conductive strips positioned on an insulating surface interconnected with resistors, or parallel conductive strips positioned on a resistive surface.

In one embodiment of the apparatus where the emissive material is a gas volume, the electrical potential gradient generating means comprises electrodes disposed at opposing regions of the gas volume, and wherein in use the electrodes have voltages applied thereto so as to provide an electrical potential gradient being oriented so as to vary from positive to negative in the general direction toward the electron target.

In one embodiment the apparatus comprises two electrodes, the first electrode disposed distal to the electron target and the second electrode disposed proximal to the electron target.

In one embodiment the apparatus comprises electrically conductive regions disposed at two opposing regions of the emissive surface, the first region being distal to the electron target and the second region being proximal to the electron target, and wherein in use the electrically conductive regions have voltages applied thereto so as to provide an electrical potential gradient being oriented so as to vary from positive to negative in the general direction toward the electron target.

In one embodiment of the apparatus the magnetic field generating means is configured to establish a magnetic field that is not precisely orthogonal to the electrostatic field and is capable of focussing an electron toward a line substantially parallel to the general direction of electron flow and in the center of the emissive surface in a region immediately above the emissive surface.

In one embodiment of the apparatus the magnetic field generating means is configured so as to not over-focus an electron so as to prevent loss of the emitted electron from the apparatus.

In one embodiment the apparatus comprises one or more electron deflectors disposed around the periphery of the emissive material and or between the emissive material and the target electrode, the deflector(s) configured so as to deflect an electron toward the central region of the emissive material and/or of the target electrode.

In one embodiment of the apparatus the deflector(s) is/are tapered along a line which is substantially parallel to the general direction of electron flow in a region immediately above the emissive surface and/or along the electron path to the target electrode In one embodiment of the apparatus the electrode target is displaced from the emissive material.

In a second aspect there is provided a method for generating and focussing an electron emitted from an emissive material onto an electron target, the method comprising the steps of:

providing an emissive material, causing or allowing an electron to be emitted from the emissive material, and providing an electrical potential gradient within the emissive material the electrical potential gradient being oriented so as to vary from positive to negative in the general direction toward the electron target, so as to prevent the emitted electron from impacting the emissive surface.

In one embodiment of the method the electrical potential gradient is provided under conditions so as to establish an electrostatic field having a series of field lines, the field lines extending from the emissive material and toward the electron target.

In one embodiment of the method the electrical potential gradient is provided under conditions such that prevention of impact is due at least in part by an interaction between the emitted electron and an electrostatic field line.

In one embodiment the method comprises the step of:

causing or allowing the emitted electron to follow a trajectory which extends outwardly from the emissive material, and then toward an electrostatic field line having an electrical potential substantially the same as the electrical potential of the emissive material at the point of emission of the emitted electron.

In one embodiment of the method where the emissive material is solid the method comprises the step of:

causing or allowing the emitted electron to be deflected away from an electrostatic field line having an electrical potential substantially the same as the electrical potential of the emissive surface at the point of emission of the emitted electron, the deflection being in a direction generally away from the emissive surface.

In one embodiment the method comprises the step of:

causing or allowing the emitted electron to be repeatedly deflected away from an electrostatic field line having an electrical potential substantially the same as the electrical potential of the emissive surface at the point of emission of the emitted electron, each of the deflections being in a direction generally away from the emissive surface.

DETAILED DESCRIPTION OF THE INVENTION INCLUDING PREFERRED EMBODIMENTS

Figure 1A:
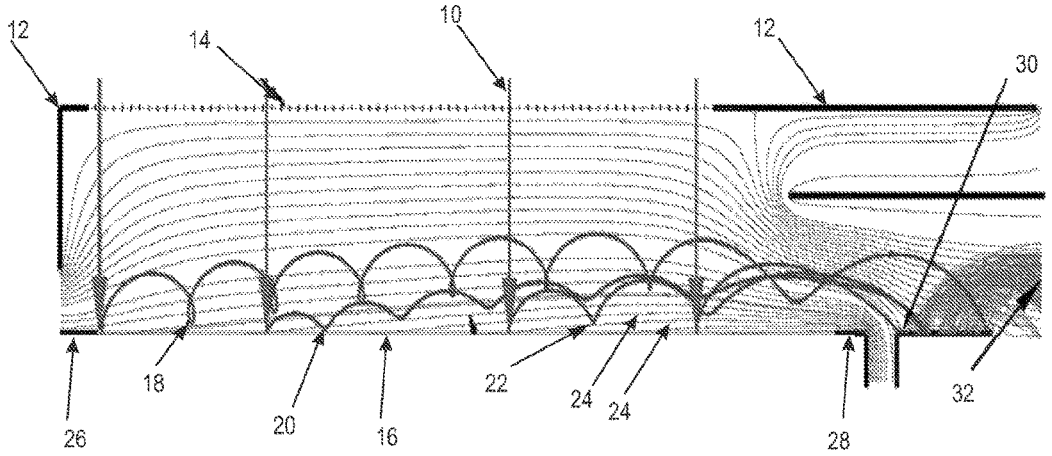
FIG. 1 is a cross-sectional schematic representation of a focussing apparatus for an electron multiplier, showing the electrostatic equi-potentials and resulting electron trajectories showing transfer of electrons from a large resistive ion impact surface to a smaller target electrode.

After considering this description it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

Throughout the description and the claims of this specification the word "comprise" and variations of the word, such as "comprising" and "comprises" is not intended to exclude other additives, components, integers or steps.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may.

The terms "emissive surface", "ion impact surface", "ion input surface" and "detector plate" are used alternatively according to context to denote an element from which a secondary electron may be emitted in response to impact with an ion or other particle. The terms "target electrode" and "target surface" are used alternatively according to context to denote an element upon which a secondary electron may impact to generate an electrical signal.

The present invention is predicated at least in part on Applicant's finding that secondary electrons emitted from an emissive surface such as an ion impact plate can be focussed onto a target electrode while preventing the electrons from impacting the plate from which they were emitted, while still conveying the electron towards a target electrode. Prevention of impact is achieved by deflection of the electrons falling back toward the impact plate in a manner that transports the electrons across the face of impact plate and toward the target electrode. Accordingly, in a first aspect the present invention provides an apparatus for generating and focussing electrons, the apparatus comprising:

an emissive material configured to emit an electron, an electron target, and an electrical potential gradient generating means configured to generate an electrical potent gradient within the emissive material, the electrical potential gradient being oriented so as to vary from positive to negative in the general direction toward the electron target, wherein, in use, an electron emitted from the emissive material is deflected away from the emissive material and generally toward the electron target.

It has been found that the electrical gradient sets up an electrostatic field about the emissive material, with the field causing a deflection of a secondary electron away from the emissive material. Thus, a secondary electron is prevented from re-entering the emissive material, and is instead conveyed directly to a target electrode. By this arrangement, the problem of different areas of the emissive material (for example, different areas of an ion impact plate) exhibiting different gains is overcome, or at least lessened. Irrespective of the region of the surface of an ion impact plate from which a secondary electrons is emitted, the electron will not re-impact on the surface. Thus, an ion impacting an area distal to the target electrode will cause only a single secondary emission, as will an ion impacting an area proximal to the target electrode.

The present invention is a significant departure from prior art methods for focussing secondary electrons. In one embodiment, the present apparatus is devoid of any extension of the amplifying section of a resistive dynode as the ion impact surface.

Without wishing to be limited by theory it is proposed that electron deflection is caused by the electrostatic field generated by the electrical potential gradient means, in combination with a magnetic field generated by a magnetic field generating means. In one embodiment, this electrostatic field is achieved by the application of a potential across a portion of or the entire emissive surface (where the emissive material is a solid). Typically, the potential is applied across opposing edges of an emissive surface, the edges which are most distal and most proximal from the target. For example, where the emissive surface is rectangular the potential may be applied across the long axis or the short axis of the rectangle by the application of a voltage to the short or long ends of the rectangle. In this way, a voltage gradient is produced across the emissive surface, in the general direction toward the target. Of course the emissive surface may be square, or have any other geometry, or indeed be devoid of a regular geometry. Irrespective of the shape, a voltage gradient is established across the emissive surface.

As will be appreciated, establishment of an electrical potential gradient across the emissive surface establishes an electrostatic field on and about the emissive surface. The field is established as a gradient. In particular, the electrostatic field manifests as a series of equipotential field lines extending from a point on the emissive surface and generally toward the electron target. Field lines proximal to the emissive surface have a more negative potential than those distal to the emissive surface. Thus, each successive field line has a slightly more positive potential than the field line beneath it. In this way, a gradient of potential extends (negative to positive) away from the emissive surface.

The field lines extend generally toward the electron target. This general extension toward the electron target in combination with the magnetic field is so as to convey secondary electrons generally toward the target. In order for electrons to be conveyed toward the target, an electrostatic gradient on the impact surface runs from positive to negative toward the target electrode, where the target electrode is more positive than any portion on the emissive surface and a magnetic field is typically established in the same vicinity and oriented to be substantially orthogonal to the direction of electron flow (toward the target).

Without wishing to be limited by theory in any way, it is proposed that secondary electrons emitted by the emissive surface follow a trajectory outwardly from the surface and then back toward the surface as a result of the magnetic field which is oriented substantially orthogonal to the plane of electron flow. In returning toward the emissive surface, an electron is deflected away from the surface by the electrostatic field in the region immediately above the surface.

It is further proposed that the electron is deflected at the level of an equipotential field line extending from the point on the emissive surface from which the electron was emitted. Once the electron traverses through the equipotential which passes through its origin toward the emissive surface it will lose all of its energy (velocity) and experience an electrostatic field which pushes it back through the equipotential and continues to accelerate it away from the surface. This is similar to rolling a ball up hill, where it eventually stops and then starts rolling back down the hill. This explanation neglects the electron's initial energy, as it is emitted from the surface, which will be near negligible for practical applications. The equipotential spacing or the field gradient above the surface must be large enough to allow for this initial energy to be lost before the electron reaches the surface. In practice this is a minimal requirement.

After a first deflection an electron may be deflected a second, third, fourth, fifth, six, seventh, eighth, ninth tenth time, or even a greater number of times as the magnetic field continues to curve the electron's trajectory toward the surface and the electrostatic equipotential deflects it away when it gets too close. The various field parameters may be adjusted so that the electron undergoes only one or two deflections on its way to the target. In this way, the electron is bounced along an equipotential line above the emissive surface, and toward the target electrode. This bouncing continues until the electron crosses an edge of the emissive area at which point the field lines are squeezed between the emissive area and the target. The electron's momentum then carries it onto the target electrode.

In an alternative embodiment a resistive surface is positioned between the emissive surface and the target electrode. The equi-potentials which originate on the emissive surface will all pass through this resistive surface. In this case this resistive surface can be part of the target surface. This configuration has an advantage for configurations where it is difficult to impart the necessary momentum onto the electrons so that they all reach the target electrode.

It will be seen from the above that variable gain effects across the emissive surface are avoided because secondary electrons are never allowed to impact the emissive surface, thereby avoiding the additional electron emissions from a second and subsequent surface interactions. Thus, for all areas of the emissive surface the impact of a single particle (such as an ion generated in mass spectrometry) results in the emission of only a first electron (or a first group of electrons) which is/are then conveyed by bouncing across the electrostatic field to the target electrode.

As will be readily understood, the target electrode is preferably shaped and/or dimensioned and/or positioned so as to allow impact of most, if not all secondary electrons conveyed to the periphery of the emissive surface. For example, the target electrode is preferably sufficiently large in surface area so as to be able to catch electrons approaching at any expected trajectory.

The physical means for establishing the electrostatic field may be any means deemed suitable by a skilled person given the benefit of the present specification. Given the functional requirements of the electrostatic field as disclosed herein, the skilled person is able to conceive of many and varied means for establishing the field. In one embodiment, the emissive surface is electrically resistive. As used herein, the term "electrically resistive" includes any level of resistance so long as an electric potential can be established and maintained across the emissive surface. As will be understood by the skilled person the resistance must be large enough so as not to require more power than is practical for the apparatus. It is contemplated that at least 1, 2, 3, 4 or 5 megohms will be practical.

In terms of materials, the emissive surface may be composed of any material known in the prior art for the emission of secondary electrons upon impact with any charged or uncharged particle. For some embodiments, the material must also have the required electrical resistance. Processed (reduced and then re-oxidised) resistive glass provides both resistive and secondary emission properties and is currently used in many electron multiplier types.

In one embodiment, the electrostatic field is established between two elongate electrodes, each electrode disposed along opposing edges of the emissive surface. The edges may be those which are most distal and most proximal with respect to the electron target. The electrodes may be composed of any electrically conductive material, however preferred materials include evaporated aluminium or conductive epoxy.

Many other arrangements for the emissive surface are possible such as multiple parallel conductive strips interconnected with resistors or parallel conductive strips positioned on a resistive surface. A general requirement may be expressed in terms of the ability to generate an electrical potential gradient along the emissive surface so that a positive to negative voltage gradient is generated along the surface in the general direction of secondary electron flow. The direction of the secondary electron flow may be determined by the direction of the electrostatic field direction combined with the direction of the magnetic field.

A potential more positive than the positive strip is typically applied to an attractor electrode which is proximal the emissive surface and displaced in the nominal direction of electron emission. Input ions typically approach the ion impact surface from the same general direction that includes the attractor electrode. To accommodate this the attractor electrode can be a grid, a plate with a hole or aperture or just to one side of the input ion beam. The result of this geometry is that equi-potentials gradually rise from the resistive surface in the direction of the secondary electron path because of the more negative voltage in this direction. As the electrons emitted from the ion impact surface return to this surface (because the magnetic field curves their trajectories)

they are deflected away from the surface (before they reach it) once they pass through the equi-potential that passes through the electron's point of emission, and are then repeatedly bounced further down this equi-potential surface which is in space above the impact surface. An electrical potential substantially more positive than the positive strip is applied to a target electrode and attracts all the emitted electrons so that they strike this electrode.

This mechanism enables unlimited extent to the ion impact input surface in the direction of secondary electron flow while confining the target to a small area. The target electrode may be the input of the amplifying section.

Reference is now made to the non-limiting example shown in FIG. 1A which shows a preferred electron generating and focussing apparatus of the present invention. Input ions 10 approach the attractor electrode 12 having an applied voltage of +300V, the ions 10 passing through apertures 14 therein. The input ions 10 contact the detector plate (ion impact surface) 16 causing the emission of secondary electrons having trajectories shown as 18, 20 and 22.

With regard to the applied voltage of the attractor electrode, it will be appreciated that the voltage may be altered from +300V in accordance with a specific application. In some embodiments, the voltage applied to the attractor electrode is greater than about 100V, 110V, 120V, 130V, 140V, 150V, 160V, 170V, 180V, 190V, 200V, 210V, 220V, 230V, 240V, 250V, 260V, 270V, 280V, 290V, 300V, 310V, 320V, 330V, 340V, 350V, 360V, 370V, 380V, 390V, 400V, 410V, 420V, 430V, 440V, 450V, 460V, 470V, 480V, 490V or 500V.

In some embodiments, the voltage applied to the attractor electrode is less than about 100V, 110V, 120V, 130V, 140V, 150V, 160V, 170V, 180V, 190V, 200V, 210V, 220V, 230V, 240V, 250V, 260V, 270V, 280V, 290V, 300V, 310V, 320V, 330V, 340V, 350V, 360V, 370V, 380V, 390V, 400V, 410V, 420V, 430V, 440V, 450V, 460V, 470V, 480V, 490V or 500V.

The electrostatic field established across the detector plate (ion impact surface) 16 is represented by the series of field lines (two of which are marked 24). The field lines 24 connect points of equal potential. The lower field lines (i.e. proximal to the detector plate 16) have a more negative potential, while the higher field lines (i.e. distal to the detector plate 16) have a more positive potential.

It will be noted that the electrostatic field is generated by a positive electrode strip 26 having an applied voltage of +125V and an opposed negative electrode strip 28 at 0V. These strips 26 and 28 abut and make electrical contact with the ends of detector plate 16.

In some embodiments, the voltage applied to the positive electrode strip is greater than about 30V, 40V, 50V, 60V, 70V, 80V, 90V, 100V, 110V, 120V, 130V, 140V, 150V, 160V, 170V, 180V, 190V, 200V, 210V, 220V, 230V, 240V, or 250V.

In some embodiments, the voltage applied to the positive electrode strip is less than about 30V, 40V, 50V, 60V, 70V, 80V, 90V, 100V, 110V, 120V, 130V, 140V, 150V, 160V, 170V, 180V, 190V, 200V, 210V, 220V, 230V, 240V, or 250V.

It will be further noted that the trajectories of the secondary electrons 18, 20 and 22 are maintained above the plate 16 so as to avoid impact with the plate 16 such that no further secondary electrons are generated. Each electron bounces along the field line having the same potential as the potential at the point on the plate 16 surface from where the electron was emitted. After crossing the edge of the electrode 28, the electrons impact the target electrode 30, set at a voltage of +300V in this example.

In some embodiments, the voltage applied to the target electrode is great than about 100V, 110V, 120V, 130V, 140V, 150V, 160V, 170V, 180V, 190V, 200V, 210V, 220V, 230V, 240V, 250V, 260V, 270V, 280V, 290V, 300V, 310V, 320V, 330V, 340V, 350V, 360V, 370V, 380V, 390V, 400V, 410V, 420V, 430V, 440V, 450V, 460V, 470V, 480V, 490V or 500V.

In some embodiments, the voltage applied to the target electrode is less than about 100V, 110V, 120V, 130V, 140V, 150V, 160V, 170V, 180V, 190V, 200V, 210V, 220V, 230V, 240V, 250V, 260V, 270V, 280V, 290V, 300V, 310V, 320V, 330V, 340V, 350V, 360V, 370V, 380V, 390V, 400V, 410V, 420V, 430V, 440V, 450V, 460V, 470V, 480V, 490V or 500V.

In some embodiments, the respective voltages applied to the positive electrode strip, and/or the attractor electrode and/or the target electrode is determined by reference to a voltage difference between any two electrodes. In some embodiments, the voltage difference is greater than about 100V, 110V, 120V, 130V, 140V, 150V, 160V, 170V, 180V, 190V, 200V, 210V, 220V, 230V, 240V, 250V, 260V, 270V, 280V, 290V, or 300V.

In some embodiments, the voltage difference is less than about 100V, 110V, 120V, 130V, 140V, 150V, 160V, 170V, 180V, 190V, 200V, 210V, 220V, 230V, 240V, 250V, 260V, 270V, 280V, 290V, or 300V.

From FIG. 1A the focussing effect is clear. The plate 16 has a relatively large surface area, and the target electrode 32 relatively small. All electrons emitted from the plate 16 are conveyed to and deposited on the smaller target electrode as a result of the focussing effect of the present apparatus. In some embodiments, the surface area of the target is less than about 90%, 80%, 70%, 60%, 50%, 40%, 30%, 20%, or 10% the surface area of the emissive surface.

After ions interact with the target, the resulting secondary electrons are conveyed to the amplifying section of the detector along the trajectories marked generally as 32.

Figure 1B:
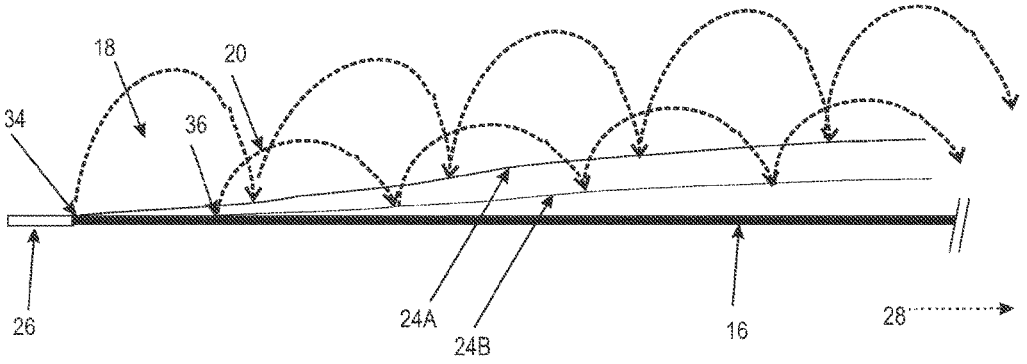
Figure 2:
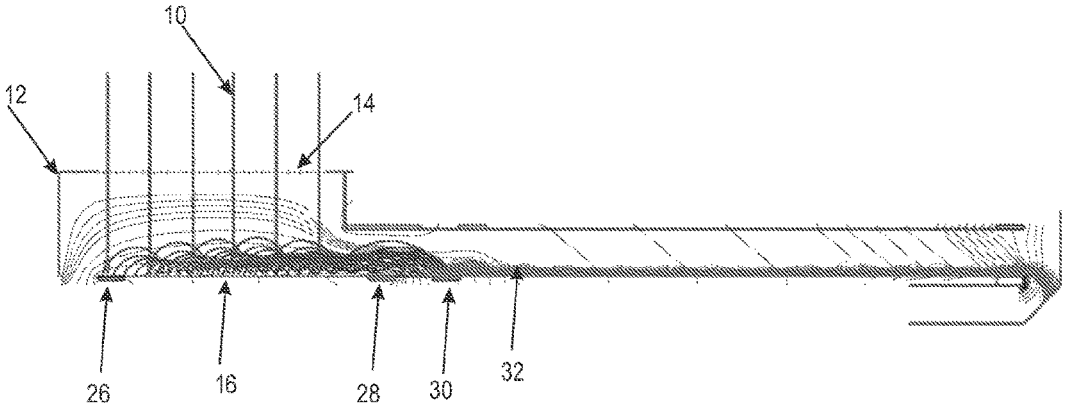
FIG. 2 is a cross-sectional schematic representation of complete electron multiplier detector incorporating the focussing mechanism shown in FIG. 1.
Figure 3:
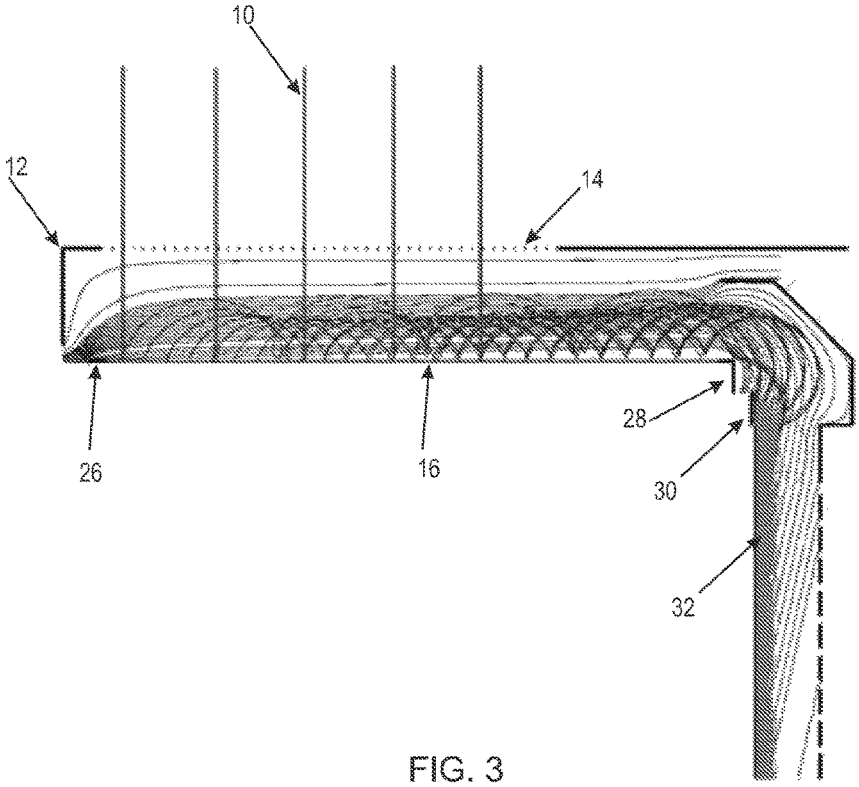
FIG. 3 is a cross-sectional schematic representation of a portion of an electron multiplier detector showing the incorporation of the focussing apparatus shown in FIG. 1, although having a different geometry to that of FIG. 2.
Figure 4:
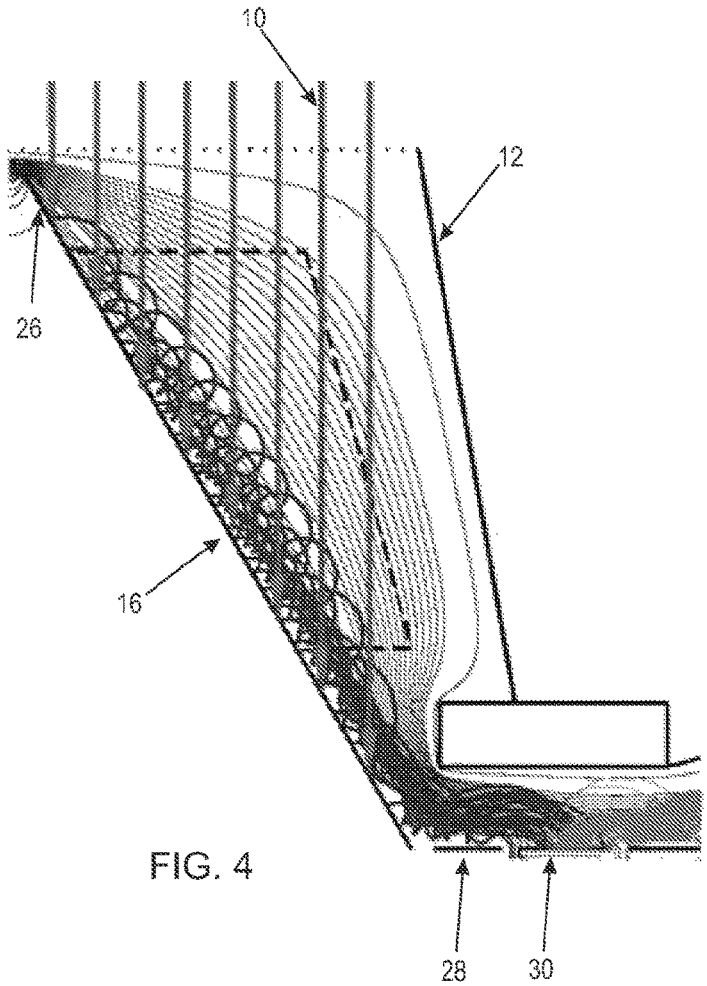
FIG. 4 is a cross-sectional schematic representation of a portion of an electron multiplier detector showing the incorporated focussing apparatus of FIG. 1 described above with an alternative geometry to that of FIG. 2 and FIG. 3. The dashed lines show the positions of side deflection electrodes.
Figure 5:
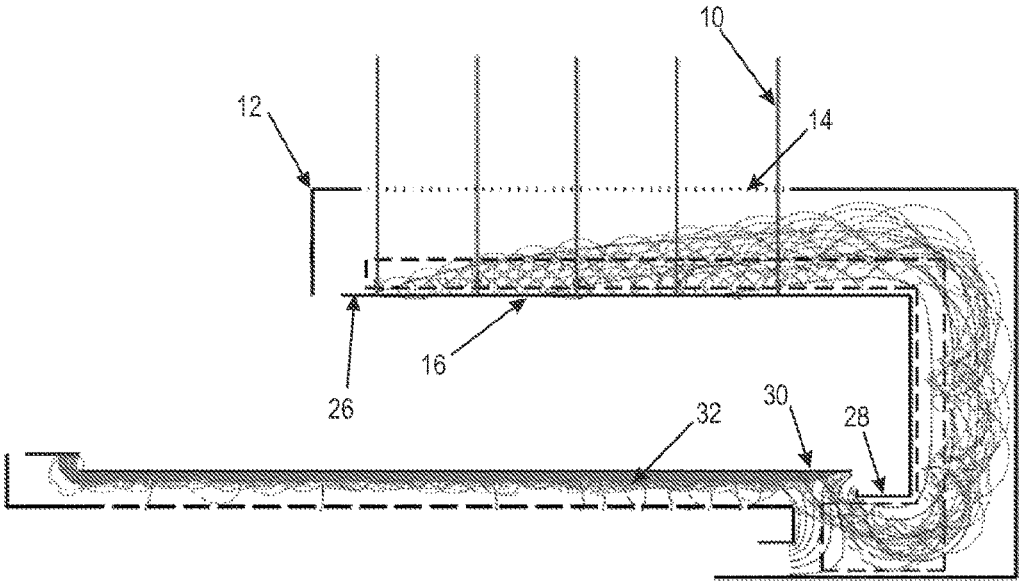
FIG. 5 is a cross-sectional schematic representation of a complete electron multiplier detector showing the incorporated focussing apparatus of FIG. 1 and utilizing an electron transport method to enable a more convoluted design. The dashed lines show positions of side deflection electrodes.

Electron bouncing is more clearly seen in FIG. 1B which shows two field lines 24A and 24B, and the trajectories 18 and 20 followed by two electrons emitted by ions impacting the plate 16 at the points 34 and 36 respectively. The impact point 34 is at a more positive potential than the impact point 36, this being due to the point 34 being more proximal to the electrode strip 26 and the voltage gradient (positive to negative) established between the electrode strips 26 and 28. Consequently, the potential of the field line 24A extending from the impact point 34 is more positive than that of the field line 24B extending from the impact point 36.

The impact of an ion may lead to the emission of several electrons all of which may travel along trajectories similar to the one indicated.

It will be noted that the field lines 24 are not exactly parallel to the plate surface 16, but extend upwardly from the surface and arch toward the electrode 28. However, it will be appreciated that the field lines run generally over the face of the plate 16 and toward to the electrode 28.

The present apparatus may further comprise magnetic field generating means, which may be configured to cause the electron deflections described supra, or to combine with the electrostatic field generating means to cause the electron deflections described supra.

The present invention is particularly useful for electrostatic/magnetic cross field electron multipliers where electrons within the device are manipulated by a combination of electrostatic and magnetic fields. In these multipliers the primary focussing mechanism is effective only in the direction of electron flow which is also an important focussing function needed for a cross field electron multiplier. A secondary focussing mechanism is also described herein infra which utilizes side flaps and/or tapered side flaps as deflectors to provide focussing in the direction orthogonal to the electron flow. This provides a funnelling effect on the electrons by directing them to be more precisely conveyed along a desired trajectory and further focussing them in the dimension that is not controlled by the over-all focussing function described supra, and thus providing focussing in a second dimension.

The magnetic field generating means may be configured to establish a magnetic field having field direction which is orthogonal to the electrostatic field lines present in a region immediately above the emissive surface and orthogonal to the plane depicted in the drawing. The magnetic field direction nominally extends into the page of the drawings herein depicting the apparatus. Typically, the magnetic field is configured so as to convey the electrons toward the target electrode.

As will be appreciated from the disclosure supra, the bouncing of electrons above the emissive surface is due completely or in part to the electrostatic field combined with the magnetic field. The electrostatic field in combination with the magnetic field may result in the bouncing of electrons along an electrostatic field line towards the target electrode. The field(s) may result in an electron trajectory that is cycloid or near cycloid.

In some embodiments, it is preferred to utilize a magnetic field that is not precisely orthogonal to the electrostatic field lines. This may be utilized to deflect electrons away from the edges of the apparatus. This method must be carefully organized to prevent over-focussing the electrons to the point that electrons are ejected from the opposite edge of the apparatus altogether and therefore fail to impact the target electrode. This manifests as a loss in signal, which is of course deleterious.

Where it is not practical to entirely prevent over-focussing, another means by which electron loss may be prevented is by use of electron deflectors preferably disposed around the periphery of the emissive surface and/or between the emissive surface and the target surface. Thus, where a stray electron is on a path to exit the apparatus the deflector acts to redirect the electron back toward a region above the emissive surface and/or between the emissive surface and the target surface so as to be better positioned to be conveyed by a magnetic field toward the target electrode.

In one embodiment, the deflector(s) are tapered along a line which is substantially parallel to the direction of electron flow in a region immediately above the emissive surface and/or between the emissive surface and the target electrode. Thus, the deflector has a funnelling effect on an electron by directing the particle to be more precisely conveyed along a desired trajectory and further focussing it in the dimension (into the page as shown in the drawings) that is not controlled by the primary focussing function of the invention. By this means the electrons are focussed in two dimensions. In other words, the spread of target positions of the electrons are reduced in size as compared to the spread of emission points in two dimensions.

Simulations have shown that for many magnetic field generating means there is a tendency to over-focus electrons in the direction orthogonal to the secondary electron flow so that electrons are lost to the opposite side of the apparatus from the side of the electron emission point. This tendency becomes more pronounced for electron emission points that are further from a central axis. This problem may be overcome by positioning side deflection electrodes at the edges of the emissive surface and/or between the emissive surface and the target surface. A potential is applied to the deflection electrode which is substantially more negative than the most negative point of the ion or particle impact on the emissive surface. As over-focussed secondary electrons approach the deflection electrodes they are deflected back toward the centre of the ion impact surface. Often a secondary electron is deflected several times in this manner before it is incident on to the target electrode. In some embodiments it may be important to extend the side deflection electrodes to the area of the target electrode.

Applicant proposes that in the present apparatus some electrons may be absorbed or deflected by surfaces of components normally present in an apparatus, and removal or repositioning of such surfaces, or altering the potential (voltage) of a surface limits the loss of electrons thereby improving signal.

In this way, the distance between the emissive surface and the target electrode may be extended indefinitely by ensuring that any surface which can be approached by an electron is at an electrical potential more negative than the potential of the electron's emission point. To this end, electrical potentials within the apparatus may be configured so that the equi-potential surfaces that pass through the emission points of any of the electrons emitted from the emissive surface do not intersect solid surfaces in the region between the emissive surface and the target and/or amplifying device. This can provide a very efficient method for transferring electrons from one position to another and can be advantageous in some detector designs.

FIGS. 2 to 5 demonstrate that by utilizing the technique described above, the present apparatus may be configured and/or stretched into a variety of shapes enabling its use in a wide variety of applications.

In one embodiment, the electron target is disposed a distance away from the ion impact. Electrical potentials within the apparatus may be arranged such that an equipotential surface that passes through an emission point of any electron emitted from the ion impact surface intersect no solid surface in the space between the impact surface and the electron target. This may be achieved by the use of one or more deflection plates positioned along the edges of electron path. A magnetic field similar to that above the emission surface is typically maintained along the electron path. This arrangement is capable of providing an efficient method for transferring electrons or charged particles over any distance from the ion impact surface to the electron target or in a variety of different configurations.

The present invention further provides methods which may or may not rely on any apparatus described herein. While the apparatus described herein are certainly useful, it is contemplated that a skilled person having the benefit of the present invention may be capable of generating and focussing electrons in an advantageous manner using other apparatus. Accordingly, in a second aspect the present invention provides a method for generating and focussing an electron emitted from an emissive material onto an electron target, the method comprising the steps of:

- providing an emissive material,
- causing or allowing an electron to be emitted from the emissive material, and
- providing an electrical potential gradient within the emissive material the electrical potential gradient being oriented so as to vary from positive to negative in the general direction toward the electron target, so as to prevent the emitted electron from impacting the emissive surface.

Various features of the apparatus may be applicable to other methods. For example, in the step of providing the emissive surface the method may require that the emissive surface is electrically resistive. As another example, any of the voltages recited in respect of the apparatus may be applied to the methods. For the sake of brevity and clarity of disclosure, features of the apparatus as applicable to the methods are incorporated at this point in the specification by way of reference.

Given the benefit of the present specification a skilled person practicing the methods is enabled to vary the amplitude and direction of the voltage gradient so as to provide for effective electron bouncing with a view to removing any uneven gain across an emissive material.

While the present apparatus and methods have been described mainly in the context of use in a generalized mass spectrometer. The present invention may be applied to specific applications where timing information is important (such as time-of-flight methods) and also to applications where timing is unimportant.

The present apparatus and methods are applicable to amplifiers such as discrete dynode electron multipliers, continuous dynode electron multipliers, micro channel plates, micro sphere plates, focussed mesh detectors, magnetically focussed electron multipliers, magnetic/electrostatic electron multipliers (also known as a cross field detectors) or any other device that can be used to amplify secondary electrons.

It is contemplated that the invention may have utility in settings other than mass spectrometers such as general charged particle detectors, in conjunction with a photo cathode as part of a photo multiplier tube, high energy particle detector, UV detector, electron detector. The charged particle transport function may have utility apart from the detection function in a wide variety of systems that involve manipulation of ions, electrons or charged particles.

While the present invention has been described mainly in terms of apparatus and methods for focussing secondary electrons caused by the impact of an ion on an emissive material, it is contemplated that utility will be found for other particles capable of causing an emissive surface to emit a secondary electron. Such particles include any charged particle, a neutral (uncharged) particle, an electron and a photon.

It will be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. Functionality may be added or deleted from the diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

The invention claimed is:

1. Apparatus for generating and focussing electrons, the apparatus comprising an emissive material configured to emit an electron, an electron target, and an electrical potential gradient generating means configured to generate an electrical potential gradient within the emissive material, the electrical potential gradient being oriented so as to vary from positive to negative in the general direction toward the electron target, wherein, in use, an electron emitted from the emissive material is deflected away from the emissive material and generally toward the electron target.

2. The apparatus of claim 1 wherein where the emissive material is solid, the electrical potential gradient generating means is configured to establish an electrical potential gradient across the surface of the emissive material.

3. The apparatus of claim 1 wherein the electrical potential gradient generating means is configured to establish an electrostatic field having a series of potential field lines.

4. The apparatus of claim 3 wherein where the emissive material is solid and the electron target is substantially planar, each of the field lines are substantially orthogonal to the electron target.

5. The apparatus of claim 1 comprising magnetic field generating means configured to combine with the electrical potential gradient generating means to guide an electron along a trajectory toward the electron target.

6. The apparatus of claim 5 wherein the magnetic field generating means is configured to establish a magnetic field having a field direction which is substantially orthogonal to the electrostatic field lines.

7. The apparatus of claim 6 wherein where the emissive material is solid, the magnetic field direction is substantially orthogonal to the electrostatic field lines present in a region immediately adjacent to the emissive surface.

8. The apparatus of claim 5 wherein where the emissive material is solid, the electrical potential gradient generating means and/or the magnetic field generating means is/are configured such that the trajectory of the electron is substantially across the emissive surface and toward the electron target.

9. The apparatus of claim 5 wherein the magnetic field generating means is configured to establish a magnetic field that is not precisely orthogonal to the electrostatic field and is capable of focussing an electron toward a line substantially parallel to the general direction of electron flow and in the center of the emissive surface in a region immediately above the emissive surface.

10. The apparatus of claim 5 wherein the magnetic field generating means is configured so as to not over-focus an electron so as to prevent loss of the emitted electron from the apparatus.

11. The apparatus of claim 1 wherein where the emissive material is solid and the surface of the emissive material is electrically resistive.

12. The apparatus of claim 1 wherein where the emissive material is solid, the surface of the emissive surface is not electrically resistive, and comprises a surface having multiple parallel conductive strips positioned on an insulating surface interconnected with resistors, or parallel conductive strips positioned on a resistive surface.

13. The apparatus of claim 1 wherein where the emissive material is a gas volume, the electrical potential gradient generating means comprises electrodes disposed at opposing regions of the gas volume, and wherein in use the electrodes have voltages applied thereto so as to provide an electrical potential gradient being oriented so as to vary from positive to negative in the general direction toward the electron target.

14. The apparatus of claim 13 comprising two electrodes, the first electrode disposed distal to the electron target and the second electrode disposed proximal to the electron target.

15. The apparatus of claim 1 comprising electrically conductive regions disposed at two opposing regions of the emissive surface, the first region being distal to the electron target and the second region being proximal to the electron target, and wherein in use the electrically conductive regions have voltages applied thereto so as to provide an electrical potential gradient being oriented so as to vary from positive to negative in the general direction toward the electron target.

16. The apparatus of claim 1 comprising one or more electron deflectors disposed around the periphery of the emissive material and or parts or all of the region between the emissive material and the electron target, the deflector(s) configured so as to deflect an electron toward the central region of the emissive material and/or of the target electrode.

17. The apparatus of claim 10 wherein the deflector(s) is/are tapered along a line which is substantially parallel to the general direction of electron flow in a region immediately above the emissive surface and/or along the electron path to the target electrode.

18. The apparatus of claim 1 wherein the electrode target is displaced from the emissive material.

19. A method for focussing an electron emitted from an emissive material onto an electron target, the method comprising:

providing an emissive material, causing or allowing an electron to be emitted from the emissive material, and providing an electrical potential gradient within the emissive material the electrical potential gradient being oriented so as to vary from positive to negative in the general direction toward the electron target, so as to prevent the emitted electron from impacting the emissive surface.

20. The method of claim 19 wherein the electrical potential gradient is provided under conditions so as to establish an electrostatic field having a series of field lines, the field lines extending from the emissive material and toward the electron target.

* * * * *